US007149456B2

(12) United States Patent
Yamagata

(10) Patent No.: US 7,149,456 B2
(45) Date of Patent: Dec. 12, 2006

(54) IMAGE FORMING DEVICE

(75) Inventor: Takashi Yamagata, Otsu (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 108 days.

(21) Appl. No.: 11/060,343

(22) Filed: Feb. 17, 2005

(65) Prior Publication Data

US 2005/0201774 A1 Sep. 15, 2005

(30) Foreign Application Priority Data

Mar. 9, 2004 (JP) ..... 2004-065296

(51) Int. Cl.
*G03G 21/00* (2006.01)

(52) U.S. Cl. ..... 399/98

(58) Field of Classification Search ..... 15/1.51, 15/256.5, 256.51, 256.52; 399/91, 98
See application file for complete search history.

(56) References Cited

U.S. PATENT DOCUMENTS 5,717,505 A * 2/1998 Chang et al. ..... 358/498
6,708,009 B1 * 3/2004 Fuwazaki et al. ..... 399/98

FOREIGN PATENT DOCUMENTS

JP 2003-081477 3/2003
JP 2003-307987 10/2003

* cited by examiner

*Primary Examiner*—Hoang Ngo
(74) *Attorney, Agent, or Firm*—Hogan & Hartson LLP

(57) ABSTRACT

An image forming device includes a transportation path, a transportation roller and a foreign particle collecting mechanism. The transportation path extends approximately upward from a paper feed cassette which sequentially feeds paper for printing an image. The transportation path transports the paper from the paper feed cassette via an image forming unit, which prints a desired image onto the paper, to a paper discharge tray. The transportation roller is provided at the transportation path upstream of the image forming unit. The foreign particle collecting mechanism removes a foreign particle adhered to a roller surface of the transportation roller. The paper feed cassette includes a container for receiving a foreign particle dropped off from the foreign particle collecting mechanism.

20 Claims, 5 Drawing Sheets

IMAGE FORMING DEVICE

BACKGROUND OF THE INVENTION

1. Field of the Invention

The present invention relates to an image forming device for printing a character or an image onto paper in a printer, a facsimile machine and a copying machine or the like.

2. Description of Related Art

A printer, a facsimile machine and a copying machine or the like includes an image forming device for printing a character or an image onto paper. FIG. 5 shows an example of a conventional image forming device. The surface of a photoconductive drum 902 is charged by a charging device 901 which is impressed with a prescribed bias voltage. A Light Emitting Diode (LED) head 903 selectively exposes the photoconductive drum 902 according to image information. Accordingly, an electrostatic latent image is formed on the surface of the photoconductive drum 902. A developing device 904 supplies a charged toner to the electrostatic latent image and forms a toner image. The toner image is transferred onto the paper by a transfer device 905 which is impressed with a prescribed bias voltage. Then, the paper is heated and pressurized by a fixing device 906 and the toner image transferred onto the paper is fixed. Meanwhile, after a charge elimination device 907 eliminates an electric charge from a surface of the photoconductive drum 902 on which the toner is transferred, a cleaning device 908 removes the toner remaining on the surface so that the photoconductive drum 902 can be charged again by the charging device 901.

In the conventional image forming device, a paper for printing an image is previously accommodated in a paper feed cassette or the like. When printing an image, the paper is fed from the paper feed cassette to a transportation path. Then, as described above, the toner image is transferred and fixed in the transportation path. However, in such an image forming device, there is a drawback that a foreign particle such as paper dust adhered to the paper causes a defect in an image or a defect in the transportation of the paper. For example, when the paper dust of the paper or the like adheres to the photoconductive drum 902, a defect in an image such as a fog and a black line is generated. To prevent such a defect, the cleaning device 907 removes the paper dust or the like adhered to the photoconductive drum 902 along with the remaining toner.

When the paper dust or the like adheres to a transportation roller, the paper slips with respect to the transportation roller and causes a defect in the transportation. Moreover, the paper dust or the like adhered to the transportation roller adheres again to a subsequent paper and is transferred to the photoconductive drum 902 to cause a defect in an image. To prevent such a defect, a proposed structure provides a paper dust removing member in the form of a blade that is pressed against the transportation roller to scrape off the paper dust or the like adhered to the transportation roller.

The scraped off foreign particle is accumulated according to the number of transported paper. Therefore, a space is required in proximity to the paper dust removing member for providing a container or the like that stores the foreign particle. However, to use an office space efficiently, recently, the downsizing of a printer, a facsimile machine and a copying machine or the like is strongly demanded. To downsize the image forming device, a space for providing a container with a large capacity is difficult to be secured. Meanwhile, in case of paper having poor quality, a large amount of foreign particles such as the paper dust may be adhered to the paper. If the container is small, only a small amount of foreign particles can be stored. Therefore, maintenance work is carried out frequently for removing the foreign particles stored in the container.

SUMMARY OF THE INVENTION

The present invention has been made in consideration of the above-described circumstances. An advantage of the present invention is to provide a mechanism for storing a foreign particle such as paper dust removed from paper and downsizing the device.

According to an aspect of the present invention, an image forming device includes a transportation path, a transportation roller and a foreign particle collecting mechanism. The transportation path extends approximately upward from a paper feed cassette which sequentially feeds papers for printing an image. The transportation path transports the paper from the paper feed cassette via an image forming unit to a paper discharge tray. The image forming unit prints a desired image onto the paper. The transportation roller is provided at the transportation path upstream of the image forming unit. The foreign particle collecting mechanism removes a foreign particle adhered to a roller surface of the transportation roller. A foreign particle storage unit is provided in the paper feed cassette for receiving the foreign particle dropped off from the foreign particle collecting mechanism.

According to another aspect of the present invention, the foreign particle collecting mechanism includes a scraping portion, a concave groove and a transportation member. The scraping portion makes contact with the roller surface of the transportation roller. The concave groove is provided beside the scraping portion and receives the scraped off foreign particle. The transportation member transports the foreign particle in the concave groove to one end of the concave groove and drops off the foreign particle.

According to another aspect of the present invention, approximately directly above the transportation roller, the transportation path leading from the paper feed cassette to the image forming unit is curved so as to slide a printing surface of the transported paper against a guide surface.

According to the present invention, in the image forming device, the foreign particle storage unit is provided in the paper feed cassette for receiving the foreign particle dropped off from the foreign particle collecting mechanism. Therefore, a container for storing the foreign particle is not required to be provided in proximity to the foreign particle collecting mechanism. A free space in the paper feed cassette is used efficiently. The image forming device can be downsized and a storage space with a large capacity can be secured.

According to the present invention, the foreign particle collecting mechanism includes the scraping portion, which makes contact with the roller surface of the transportation roller, the concave groove, which is provided beside the scraping portion and receives the scraped off foreign particle, and the transportation member, which transports the foreign particle in the concave groove to one end of the concave groove and drops off the foreign particle. Therefore, the foreign particle scraped off into the concave groove can be dropped off from a constant position to the foreign particle storage unit. Thus, the foreign particle can be stored easily and reliably.

According to the present invention, approximately directly above the transportation roller, the transportation path leading from the paper feed cassette to the image forming unit is curved so as to slide a printing surface of the transported paper against a guide surface. Therefore, when the transportation roller nips the paper, the paper dust or the like is adhered to the transportation roller and removed from the paper. In addition, the paper dust or the like removed by the paper being slid against the guide surface is dropped off onto the transportation roller. The removed paper dust or the like is collected by the foreign particle collecting mechanism. Accordingly, before reaching the image forming unit, the paper slides against the guide surface and the paper dust or the like adhered to the printing surface of the paper is removed. As a result, an amount of the paper dust or the like to be adhered to a photoconductive drum of the image forming unit can be reduced. Accordingly, a defect in an image can be prevented from generating. Moreover, the foreign particle storage unit with a large capacity is not required to be provided in the image forming unit. By downsizing the image forming unit, the image forming device can be downsized.

DETAILED DESCRIPTION OF THE INVENTION

Figure 1:
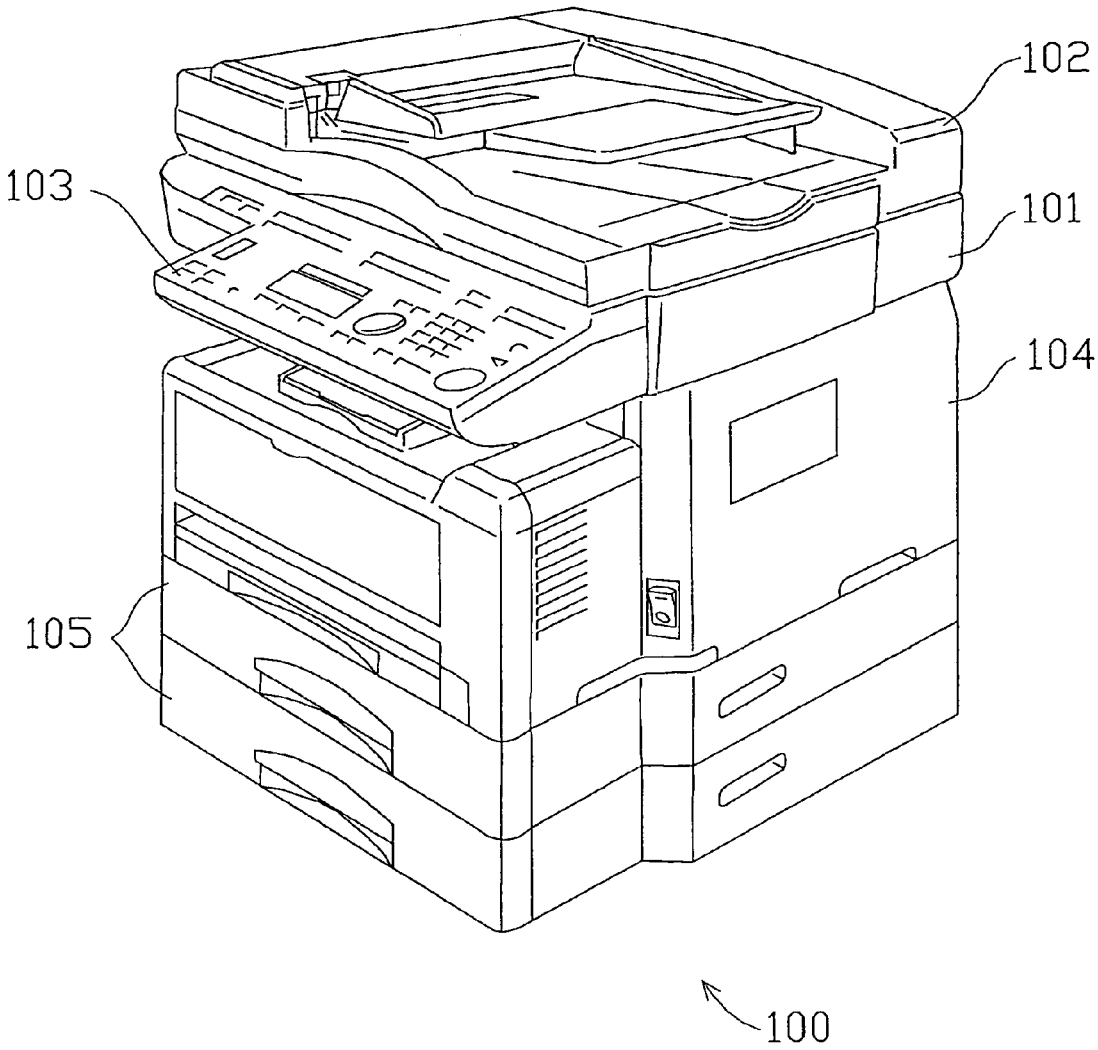
FIG. 1 is a schematic perspective view showing an exterior of a copy-and-facsimile multifunction peripheral according to an embodiment of the present invention.

FIG. 1 is a schematic perspective view showing the exterior of a copy-and-facsimile multifunction peripheral 100 having an image forming device according to an embodiment of the present invention. As shown in the drawing, the copy-and-facsimile multifunction peripheral 100 includes a scanning table 101, a document pressing cover 102, an operation panel 103, a main body 104 and paper feed cassettes 105. The scanning table 101 functions as a flat bed scanner. The document pressing cover 102 fixes an original document on the scanning table 101. The operation panel 103 is operated for, for example, inputting a start of an image scanning process or a printing process. The main body 104 includes an image forming unit for printing an image onto paper and a transmission unit for electrically transmitting an image, or the like. The paper feed cassettes 105 sequentially feed papers for printing an image. In the copy-and-facsimile multifunction peripheral 100, the image forming device is formed so that a paper is transported from the paper feed cassettes 105 to the image forming unit of the main body 104 and the image forming unit prints onto the paper, an image or a character or the like scanned by a flat bed scanner or the like.

Figure 2:
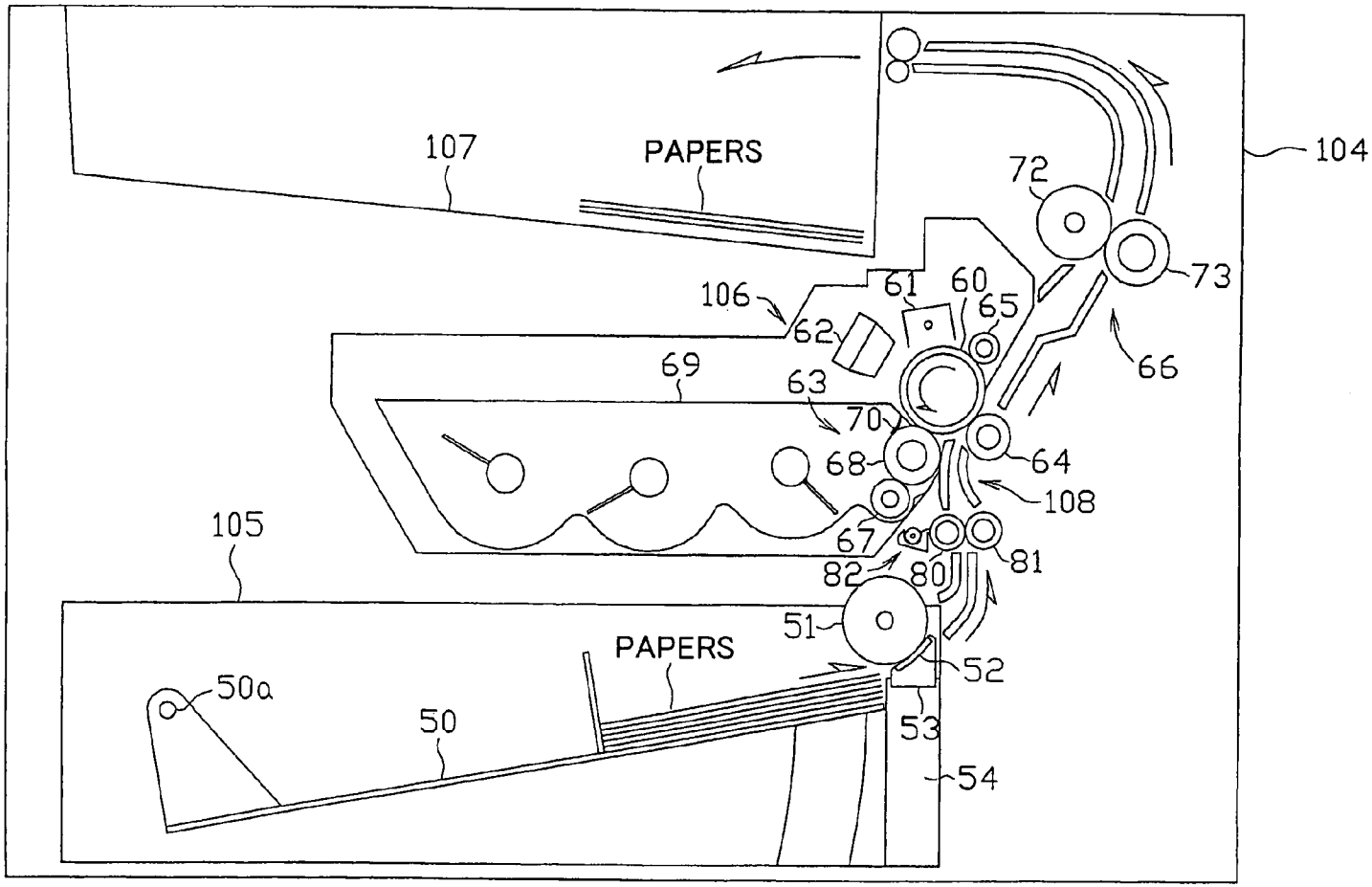
FIG. 2 shows a structure in a main body of the copy-and-facsimile multifunction peripheral.

FIG. 2 shows an inner structure of the main body 104 and the paper feed cassette 105 of the image forming device in the copy-and-facsimile multifunction peripheral 100. As shown in the drawing, the paper feed cassette 105 is disposed on a bottom part of the image forming device for sequentially feeding papers for printing an image. An image forming unit 106 is disposed above the paper feed cassette 105. A paper discharge tray 107 is disposed above the image forming unit 106. A transportation path 108 transports paper from the paper feed cassette 105 to the paper discharge tray 107. The transportation path 108 extends upward from one end of the paper feed cassette 105 and leads to the image forming unit 106. The transportation path 108 continues to extend upward and is curved in a horizontal direction to be led to the paper discharge tray 107. Further, although not shown in FIG. 2, the scanning table 101, the document pressing cover 102 and the operation panel 103 are disposed above the paper discharge tray 107. For the convenience of description, the lower paper feed cassette 105 is omitted in FIG. 2.

The paper feed cassette 105 is a box-shaped cassette which can accommodate papers of various sizes. The paper feed cassette 105 is provided at the bottom part of the image forming device in a manner capable of being drawn out. According to necessity, paper can be supplied to the paper feed cassette 105. Inside the paper feed cassette 105, a guide 50 is disposed for holding the paper of a prescribed size in a paper feed position. The guide 50 can be swung within a prescribed range with a supporting point 50*a* as a center. A bottom plate of the guide 50 is urged upward by an elastic member. Accordingly, a plurality of papers are held under a stacked state and one edge of an uppermost sheet of the papers is positioned at the paper feed position at all times. At the paper feed position, a paper feed roller 51 and a separating pad 52 are provided. The uppermost sheet positioned at the paper feed position by the guide 50 is pressed against the paper feed roller 51. The paper feed roller 51 is, for example, a silicon or an Ethylene-Propylene-Diene Methylene (EPDM) linkage roller fixed on a metal roller shaft. The paper feed roller 51 rotates while making contact with the upper post sheet and feeds the paper into the transportation path 108. A coefficient of friction of the separating pad 52 with respect to the paper is lower than a coefficient of friction of the paper feed roller 51 with respect to the paper and higher than a coefficient of friction of the papers. For example, the separating pad 52 can be formed with a urethane resin. Such a separating pad 52 is provided on an upper surface of a separating pad holder 53. The separating pad holder 53 is disposed below the paper feed roller 51 in a manner capable of moving vertically. The separating pad holder 53 is urged upward by an elastic member (not shown). Accordingly, the separating pad 52 is pressed against the roller surface of the paper feed roller 51. The papers that pass between the paper feed roller 51 and the separating pad 52 are separated and fed one sheet at a time by friction. A container (a foreign particle storage unit) 54 is disposed in the paper feed cassette 105. The container 54 will be described later.

The image forming unit 106 includes a scorotron charger (a charging device) 61, an LED printer head 62, a developing unit (a developing device) 63, a transfer unit (a transfer device) 64 and a cleaning device 65 disposed around a photoconductive drum 60. The image forming unit 106 also includes a fuser (a fixing device) 66 provided at the transportation path 108 downstream of the photoconductive drum 60.

A photoconductive layer made of an organic photoreceptor is formed on the surface of the photoconductive drum 60. The photoconductive drum 60 is rotated at a prescribed speed by a motor. The scorotron charger 61 adopts a noncontact corona charging method. Although details are not shown in the drawing, an electric discharge wire is disposed at approximately the center of a casing electrode that forms a half space. A grid electrode is disposed at a side of the scorotron charger 61 located closer to the photoconductive drum 60. When a prescribed voltage is impressed to the electric discharge wire, a corona discharge is generated and an ion content of the corona discharge is controlled by the grid electrode. The photoconductive drum 60 is charged positively by the scorotron charger 61. The photoconductive drum 60 may be charged negatively. However, by charging the photoconductive drum 60 positively, there is an advantage that an amount of ozone that is generated from the scorotron charger 61 is small. Further, in case of charging negatively, in place of the noncontact corona charging method, another charging device such as a contact-type roller charging method can be adopted.

The LED printer head 62 is a self-luminous printer head in which LED arrays are arranged for a number of printing pixels and a light emitted by the LED arrays forms an image on the surface of the photoconductive drum 60 by a SELFOC lens array. The LED printer head 62 selectively exposes the surface of the photoconductive drum 60 in accordance with image information and forms an electrostatic latent image on the surface of the photoconductive drum 60. As described above, the surface of the photoconductive drum 60 is charged positively. A surface electric potential fades at a part exposed by the LED printer head 62. By a difference in electric potentials between the exposed part and a non-exposed part, an electrostatic latent image is formed. The image information of the image of the original document scanned by the scanning table 101 that functions as a flat bed scanner is transmitted to the LED printer head 62 as an electric signal. As the exposing device, in place of the LED printer head 62, a scanning optical system device using a semiconductor laser can be adopted.

The developing unit (the developing device) 63 includes a supply roller 67, a developing roller 68 and a toner container 69. By a difference in the bias voltage impressed to each of the supply roller 67 and the developing roller 68 from an electric circuit (not shown), a toner of the toner container 69 is supplied from the toner container 69 via the feed roller 67 to the developing roller 68. A toner layer formed on the surface of the developing roller 68 is equalized by being pressed against a restriction blade 70, which is impressed with a prescribed bias voltage. As described above, the developing roller 68, which an even toner layer is formed on the surface, rotates at a position near the photoconductive drum 60. By a difference in the electric potentials between the toner of the developing roller 68 and the electrostatic latent image of the photoconductive drum 60, the toner on the developing roller 68 transfers onto the photoconductive drum 60. Accordingly, a toner image is formed on the surface of the photoconductive drum 60 in accordance with the electrostatic latent image.

The transfer unit (the transfer device) 64 is a transfer roller formed with an EPDM foam. The transfer unit 64 and the photoconductive drum 60 make contact with one another at a position facing one another across the transportation path 108. A bias voltage is impressed to the transfer unit 64 from an electric circuit (not shown) and the toner image on the photoconductive drum 60 is transferred onto the paper. Further, in place of a contact-type electrically conductive roller like the transfer unit 64, a noncontact-type transfer device like the corona transfer unit can be adopted.

The cleaning device 65 is a cleaning roller formed with an EPDM foam. The cleaning device 65 makes contact with the photoconductive drum 60 after the transfer process. By impressing a constant voltage to the cleaning device 65 from an electric circuit (not shown), a toner or a paper dust remaining on the surface of the photoconductive drum 60 is removed and the electrostatic latent image is erased. Accordingly, the surface of the photoconductive drum 60 is cleaned and the photoconductive drum 60 can be used repeatedly. Further, as the cleaning device, another contact-type method using a blade or the like or a noncontact-type method can be adopted, and also, a cleaning-less method can be adopted. The above-described photoconductive drum 60, the scorotron charger 61, the LED printer head 62, the developing unit 63 and the cleaning device 65 can be formed integrally as a process cartridge. The process cartridge can be inserted removably into the main body 104 of the copy-and-facsimile multifunction peripheral 100. When replenishing the toner, the process cartridge can be exchanged.

The fuser 66 includes a heat roller 72 and a pressure roller 73, which are provided facing one another across the transportation path 108. For fixing the toner image, the fuser 66 heats and pressurizes the paper on which the toner image is transferred. A surface of the heat roller 72 is maintained at a prescribed temperature by a heater (not shown). The pressure roller 73 is pressed against the heat roller 72 under a prescribed pressure. When the paper on which the toner image is transferred is nipped between the heat roller 72 and the pressure roller 73, the toner on the paper is heated and pressurized to be fixed. By the image forming unit 106 configured as described above, the image or the like of the original document scanned by the scanning table 101 is printed onto the paper.

Figure 3:
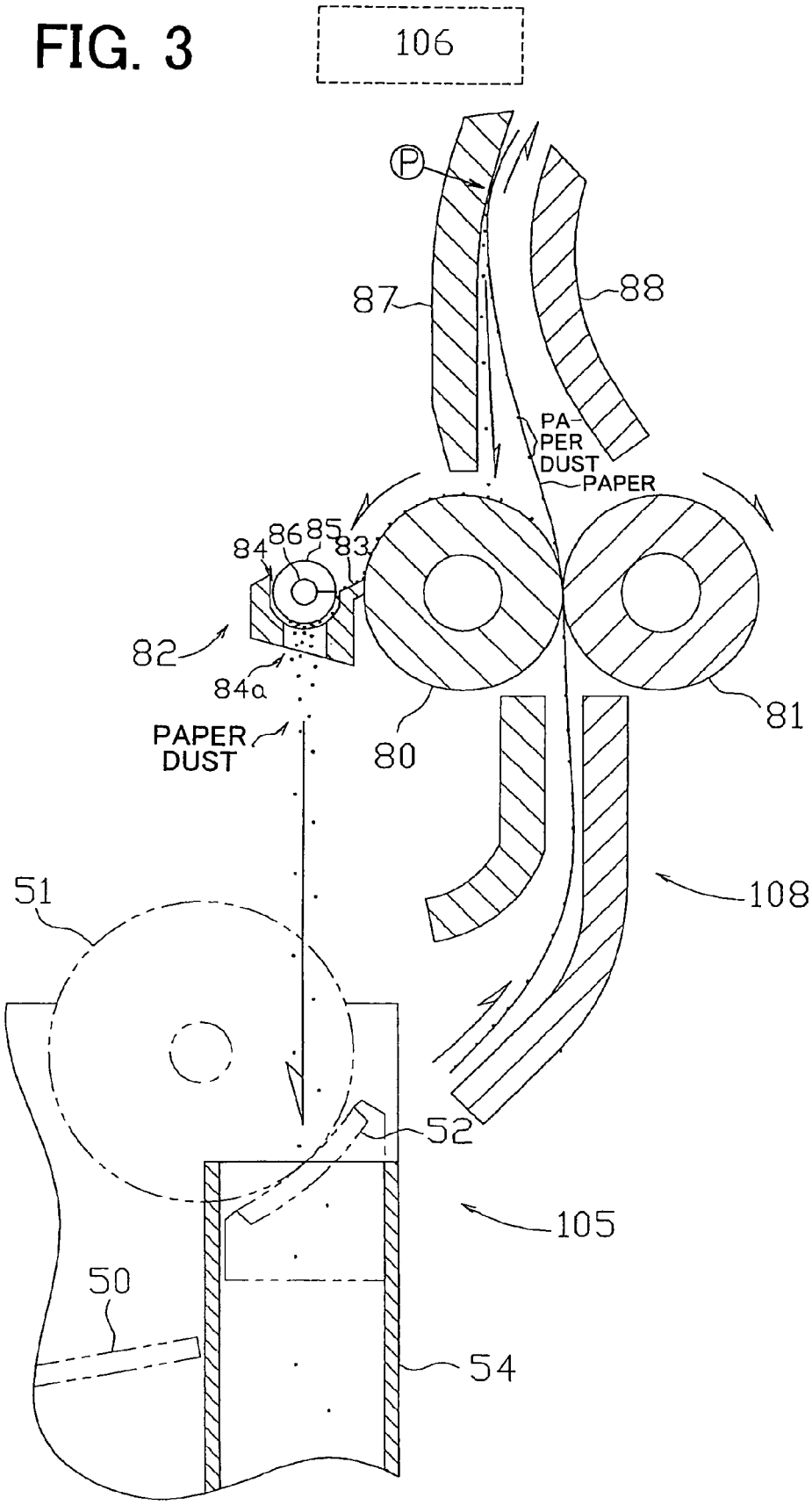
FIG. 3 is an enlarged view showing a structure in proximity to a foreign particle collecting mechanism and a container.

The paper is transported along the transportation path 108 from the paper feed cassette 105 to the image forming unit 106. The paper on which the image is printed is transported onto the paper discharge tray 107. As shown in FIG. 3, the transportation path 108 extends approximately upward from the paper feed cassette 105 to the image forming unit 106. Along the transportation path 108 between the paper feed cassette 105 and the image forming unit 106, a pair of transportation rollers 80 and 81, which transport the paper by nipping the paper, are provided. The transportation rollers 80 and 81 are EPDM rollers which rotate when roller shafts receive a rotational force from a drive source such as a motor. The pair of transportation rollers 80 and 81 are disposed so that roller surfaces make contact with one another at a position facing one another across the transportation path 108.

A foreign particle collecting mechanism 82 is provided to the transportation roller 80 located at a printing surface side of the paper, in other words, at a side where the photoconductive drum 60 of the image forming unit 106 is provided. The foreign particle collecting mechanism 82 removes paper dust or the like adhered to the roller surface of the transportation roller 80. The transportation roller 80 is wider than a maximum width of a transported paper. The roller surface of the transportation roller 80 makes contact with the printing surface of the paper and the paper dust adhered to the printing surface moves onto the roller surface.

Figure 4:
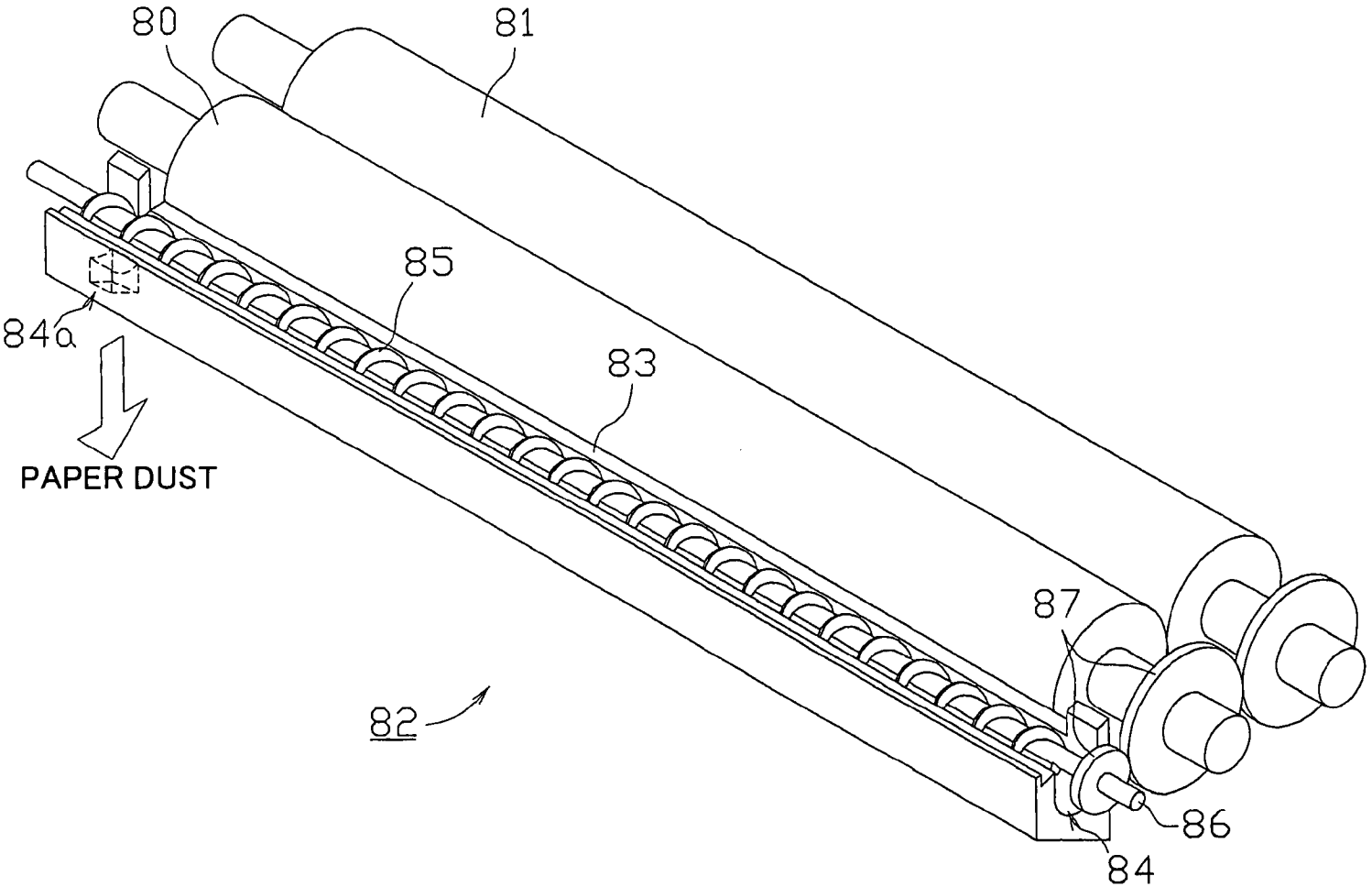
FIG. 4 is a schematic perspective view showing the structure of the foreign particle collecting mechanism.
Figure 5:
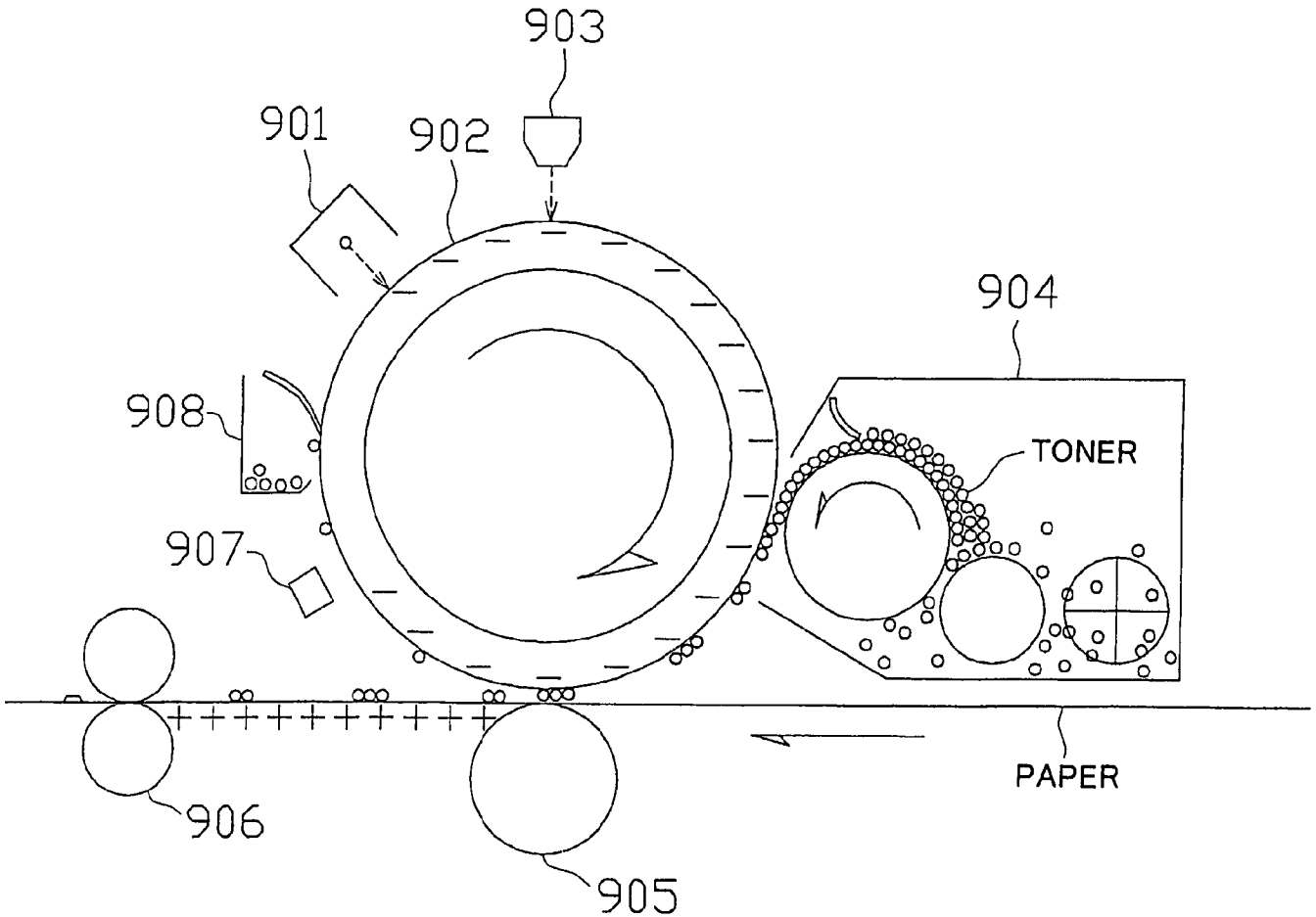
FIG. 5 shows an example of a conventional image forming device.

As shown in FIG. 3 and FIG. 4, the foreign particle collecting mechanism 82 includes a scarping portion 83 making contact with the roller surface of the transportation roller 80, a concave groove 84 disposed beside the scraping portion 83, and a helical blade (a transportation member) 85 provided in the concave groove 84. The foreign particle collecting mechanism 82 is disposed above the paper feed cassette 105. The scarping portion 83 and the concave groove 84 are formed integrally at the side of the transportation roller 80. The scarping portion 83 protrudes in an approximately horizontal direction over an axial direction of the transportation roller 80. A leading edge of the scraping portion 83 is in a form of a blade making contact with the roller surface of the transportation roller 80. The concave groove 84 is formed continuously at a base edge of the scraping portion 83. The paper dust or the like adhered to the roller surface of the transportation roller 80 is scraped off into the concave groove 84 by the scraping portion 83. A bottom part of the concave groove 84 is formed semicircular. A through hole 84*a* is formed through an end part of the concave groove 84 at a rear side of the image forming device for allowing the paper dust or the like to be dropped off. In the concave groove 84, the helical blade 85 is disposed in proximity to the semicircular bottom part in a manner that the helical blade 85 can rotate with a shaft 86 as a center. A drive force is transmitted from the transportation roller 80 via a pulley 87 to the shaft 86. The paper dust or the like scraped off into the concave groove 84 is transported to the rear side of the image forming devices along the concave groove 84 by the rotation of the helical blade 85 and dropped off downward from the through hole 84*a*. The paper dust or the like adhered to the transportation roller 80 is removed at all times by the foreign particle collecting mechanism 82. Therefore, the paper dust is not adhered again to papers transported subsequently. The removed paper dust or the like is transported along the concave groove 84 and dropped off from a constant position at all times from the through hole 84*a*.

As shown in the drawing, the container 54 in the paper feed cassette 105 is disposed directly below the through hole 84*a* of the concave grieve 84 of the foreign particle collecting mechanism 82. As described above, the paper feed cassette 105 is a box shaped cassette which can accommodate papers of various sizes. For example, in case a maximum size of the paper is A3 size, a projected area of the copy-and-facsimile multifunction peripheral 100 and the paper feed cassette 105 provided at the bottom part of the image forming device are larger than the A3 sized paper. Meanwhile, the guide 50 provided in the paper feed cassette 105 is approximately the same or slightly larger than the maximum size of the paper. Therefore, a space is provided around an edge of the paper feed cassette 105, for example, at a rear side of the paper feed cassette 105. The width of the foreign particle collecting mechanism 82 is approximately the same as the width of the transportation roller 80. The width of the transportation roller 80 is wider than the maximum width of the paper. Therefore, a plan position of the through hole 84*a* of the concave groove 84 approximately corresponds with the space at the rear side of the paper feed cassette 105. Thus, by disposing the container 54 at the rear side of the paper feed cassette 105 and directly below the through hole 84*a* of the concave groove 84, the foreign particle dropped off from the through hole 84*a* can be stored into the container 54 and the container 54 can be formed to have a large capacity. Therefore, a space for storing the foreign particle is not required to be secured in proximity to the foreign particle collecting mechanism 82. The image forming device can be downsized and the storage space with a large capacity can be secured. The container 54 is box shaped and has an opening at an upper part. For example, a plastic molding as the container 54 can be fixed or provided removably in the paper feed cassette 105. Alternatively, the container 54 can be formed integrally with the paper feed cassette 105. Although not shown in the drawing, to prevent the dropped foreign particles from scattering, a chute or the like for guiding the foreign particles to the container 54 can be provided below one end of the concave groove 84. If such a chute or the like is provided, the container 54 is not necessarily required to be disposed directly below the through hole 84*a* of the concave groove 84. In the present embodiment, since the paper dust or the like in concave groove 84 is dropped from the rear side of the image forming device through the through hole 84*a*, the container 54 is disposed at the rear side of the image forming device. However, the through hole 84*a* can be formed at an end part of the concave groove 84 located to a front side of the image forming device, the paper dust or the like can be dropped off from the through hole 84*a* located to the front side, and the container 54 can be disposed to the front side of the image forming device. Even in this case, the same effect can be obtained.

Meanwhile, as shown in FIG. 3, the transportation path 108 leading from the paper feed cassette 105 to the image forming unit 106 is formed approximately in the shape of the letter-S in which curved centers upstream and downstream of the transportation rollers 80 and 81 are disposed on opposite sides of one another. That is, the transportation path 108 extending diagonally upward from the paper feed position of the paper feed cassette 105 curves in an arc shape with the left side of the traveling direction as the curve center to face approximately vertical direction and reaches the transportation rollers 80 and 81. Then, the transportation path 108 curves in an arc shape with the right side of the traveling direction as the curve center to face diagonally upward again and is led to the image forming unit 106. A guide surface at an outer side of the curved part of the transportation path 108 located downstream of the transportation rollers 80 and 81 is a sliding position P of the printing surface of the paper.

The transportation path 108 is formed by a pair of transportation guides 87 and 88 disposed at a prescribed interval for allowing the paper to pass through. At the curve part of the transportation path 108, the paper is guided to make contact with the transportation guides 87 and 88 and to be sagged along the curve of the transportation path 108. Therefore, in the transportation path 108 located downstream of the transportation rollers 80 and 81, the transported paper makes contact with the transportation guide 87 at the outer side of the curved part and sags from the approximately vertical direction to the right side of the traveling direction. The paper slides against the sliding position P under a state in which the printing surface of the paper makes contact with the guide surface of the transportation guide 87. Accordingly, the paper dust or the like adhered to the printing surface of the paper is brushed off. Although not shown in the drawing, a rib can be provided appropriately on the guide surface of the transportation guide 87. If the transportation guide 87 is formed with a plastic material or the like, a charge elimination brush or the like can be provided for eliminating a static electricity that is generated when the paper slides against the transportation guide 87. The transportation guides 87 and 88 that constitute the transportation path 108 can be formed with a resin or the like shaped into a plate shape. Alternatively, the transportation guides 87 and 88 can be provided to function also as a housing of the main body 104 or the process cartridge or the like.

The sliding position P is located approximately directly above the transportation roller 80 at the printing surface side. The paper dust or the like brushed off at the sliding position P falls along the guide surface of the transportation guide 87 onto the transportation roller 80. In the same manner as described above, accompanying the rotation of the transportation roller 80, the paper dust or the like is scraped off from the transportation roller 80 by the foreign particle collecting mechanism 82 and stored into the container 54 in the paper feed cassette 105. As described above, when the transportation rollers 80 and 81 nip the paper, the paper dust or the like of the paper is removed. In addition, the printing surface of the transported paper is slid against the guide surface at the sliding position P located further downstream and the paper dust or the like remaining on the printing surface is brushed off. Therefore, even when a large amount of foreign particles such as the paper dust is adhered to the paper, the foreign particles can be removed from the paper before the paper reaches the image forming unit 106. An amount of the paper dust or the like that adheres to the photoconductive drum 60 of the image forming unit 106 can be reduced and a defect in the image can be prevented from generating. Moreover, accompanying a decrease in the amount of the paper dust or the like that adheres to the photoconductive drum 60, the amount of the paper dust or the like to be removed by the cleaning device 67 also decreases. Therefore, the cleaning device 65 is not required to be provided with a container with a large capacity for storing the paper dust or the like. As a result, the image forming unit 106 can be downsized. Meanwhile, as described above, the capacity of the container 54 is increased by using a free space in the paper feed cassette 105. Therefore, before the paper reaches the image forming unit 106, a large amount of the paper dust or the like adhered to the paper can be removed from the paper and stored in one location. Moreover, since the transportation path 108 leading from the paper feed cassette 105 to the image forming unit 106 is formed approximately in the shape of the letter-S, the paper can be transported smoothly without placing an excessive load on the paper. In addition, the above-described effect can be obtained by a simple structure.

Further, the structure of the copy-and-facsimile multifunction peripheral 100 shown in the present embodiment is one example. A design of the copy-and-facsimile multifunction peripheral 100 can be changed appropriately without departing from a scope of the present invention. For example, a foreign particle collecting mechanism can be provided to the transportation roller 81 that transports the paper by making contact with the surface opposite the printing surface of the paper. A number of the transportation rollers 80 and 81 can be increased appropriately according to the distance of the transportation path 108. A structure of the image forming unit 106 can be changed to another known structure.

The invention claimed is:

1. An image forming device, comprising:

a paper feed cassette which sequentially feeds paper for printing an image;

an image forming unit which prints a desired image onto the paper;

a transportation path which extends approximately upward from the paper feed cassette and transports the paper onto a paper discharge tray via the image forming unit;

a transportation roller which is provided at the transportation path upstream of the image forming unit;

a foreign particle collecting mechanism which removes a foreign particle adhered to a roller surface of the transportation roller; and a foreign particle storage unit which is provided in the paper feed cassette and receives a foreign particle dropped off from the foreign particle collecting mechanism.

2. The image forming device according to claim 1, wherein the foreign particle collecting mechanism includes a scraping portion which makes contact with the roller surface of the transportation roller and scraps off the foreign particle, a concave groove which is provided besides the scraping portion and receives the scrapped off foreign particle, and a transportation member which transports the foreign particle in the concave groove to one end and drops off the foreign particle.

3. The image forming device according to claim 1, wherein approximately directly above the transportation roller, the transportation path leading from the paper feed cassette to the image forming unit is curved so as to slide a printing surface of the transported paper against a guide surface.

4. The image forming device according to claim 2, wherein approximately directly above the transportation roller, the transportation path leading from the paper feed cassette to the image forming unit is curved so as to slide a printing surface of the transported paper against a guide surface.

5. The image forming device according to claim 2, wherein the scraping portion protrudes in an approximately horizontal direction over an axial direction of the transportation roller, and a leading edge of the scraping portion is in a form of a blade making contact with the roller surface of the transportation roller.

6. The image forming device according to claim 2, wherein the scraping portion and the concave groove are formed integrally.

7. The image forming device according to claim 2, wherein a bottom part of the concave groove is formed semicircular.

8. The image forming device according to claim 6, wherein a bottom part of the concave groove is formed semicircular.

9. The image forming device according to claim 2, wherein a through hole is formed through an end part of the concave groove.

10. The image forming device according to claim 6, wherein a through hole is formed through an end part of the concave groove.

11. The image forming device according to claim 7, wherein a through hole is formed through an end part of the concave groove.

12. The image forming device according to claim 8, wherein a through hole is formed through an end part of the concave groove.

13. The image forming device according to claim 2, wherein the transportation member is a helical blade.

14. The image forming device according to claim 9, wherein the foreign particle storage unit is disposed at a rear side of the paper feed cassette and directly below the through hole.

15. The image forming device according to claim 1, wherein the foreign particle storage unit is a box-shaped container having an opening at an upper part.

16. The image forming device according to claim 14, wherein the foreign particle storage unit is a box-shaped container having an opening at an upper part.

17. The image forming device according to claim 15, wherein the container is a plastics molding.

18. The image forming device according to claim 16, wherein the container is a plastics molding.

19. An image forming device, comprising:

a paper feed cassette which sequentially feeds paper for printing an image;

an image forming unit which prints a desired image onto the paper;

a transportation path which extends approximately upward from the paper feed cassette and transports the paper onto a paper discharge tray via the image forming unit;

means for transporting provided at the transportation path upstream of the image forming unit;

a foreign particle collecting mechanism which removes a foreign particle adhered to the means for transporting; and a foreign particle storage unit which is provided in the paper feed cassette and receives a foreign particle dropped off from the foreign particle collecting mechanism.

20. A method for forming an image, comprising:

sequentially feeding paper for printing an image;

printing a desired image onto the paper;

extending a transportation path approximately upward from a paper feed cassette and transporting the paper onto a paper discharge tray via an image forming unit;

providing a transportation roller at the transportation path upstream of the image forming unit;

removing a foreign particle adhered to a roller surface of the transportation roller by a foreign particle collecting mechanism; and receiving a foreign particle dropped off by the foreign particle collecting mechanism by a foreign particle storage unit provided in the paper feed cassette.

* * * * *